United States Patent [19]

Pickles

[11] 4,167,834

[45] Sep. 18, 1979

[54] POWER WINDOW MECHANISM

[75] Inventor: Joseph Pickles, Birmingham, Mich.

[73] Assignee: Ferro Manufacturing Corporation, Detroit, Mich.

[21] Appl. No.: 877,889

[22] Filed: Feb. 15, 1978

[51] Int. Cl.[2] ..... E05F 15/16

[52] U.S. Cl. ..... 49/358; 49/349; 49/362

[58] Field of Search ..... 49/227, 349, 358, 362, 49/375

[56] References Cited

U.S. PATENT DOCUMENTS

| | | | |
|---|---|---|---|
| 3,125,334 | 3/1964 | Lohr | 49/349 X |
| 3,208,298 | 9/1965 | Pickles | 49/349 X |
| 3,591,982 | 7/1971 | Nantau | 49/227 |
| 3,736,702 | 6/1973 | Pickles | 49/362 |

*Primary Examiner*—Kenneth Downey

*Attorney, Agent, or Firm*—Whittemore, Hulbert & Belknap

[57] ABSTRACT

A power window regulator for an automobile vehicle in which a substantially vertical post of special design is formed from sheet material and is provided at a laterally projecting edge with a series of rack teeth. A window is provided with a mounted bracket at its lower edge. The bracket supports a motor and transmission including a pinion engageable with the rack teeth to effect vertical movement of the window, bracket, motor and transmission on the rack.

6 Claims, 17 Drawing Figures

14
10
44
12a
56
16
6
42
40
38
36
114
112
52
22
94
104
102
100
108
111
118
50
60
96
12
54
34
116
4
11

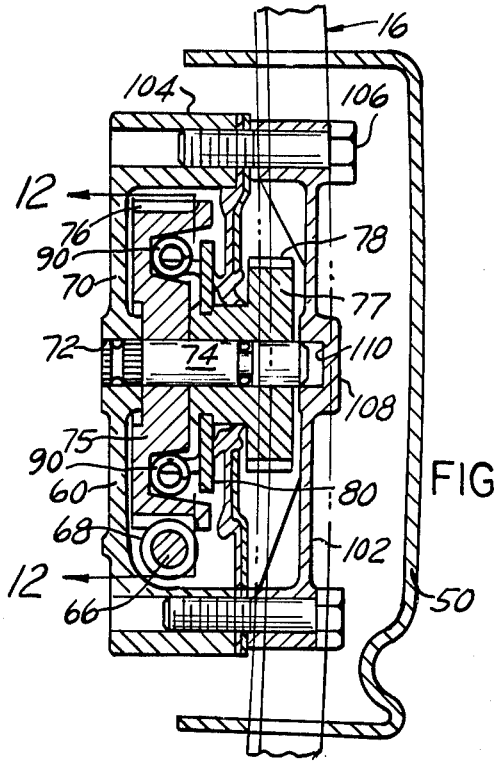
FIG. 11
FIG. 12
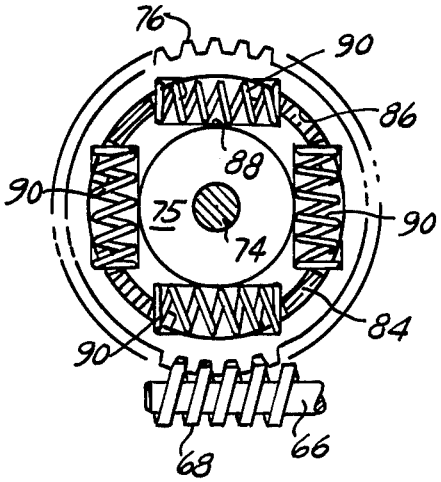
FIG. 13
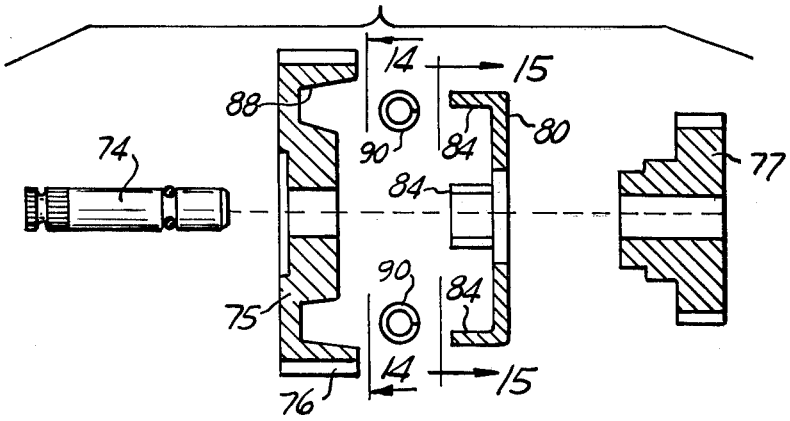
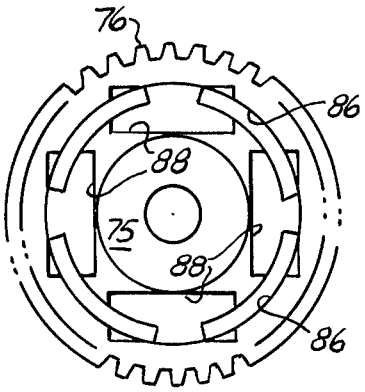
FIG. 14
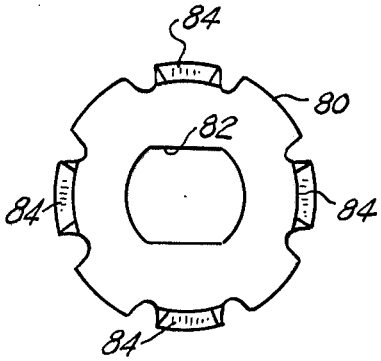
FIG. 15

POWER WINDOW MECHANISM

GENERAL DESCRIPTION

The present invention relates to window regulating mechanism for use in motor vehicles and is an improvement over the construction disclosed in my prior patent, U.S. Pat. No. 3,736,702. The window is vertically movable from an open position, in which it is housed in the interior of a hollow door, to a closed position in which it closes the window opening and engages structure at the edges of the opening to provide a seal.

The mechanism for effecting vertical movement of the window between open and closed positions comprises a rack extending vertically within the space in which the window is housed. The window is secured at its lower edge to a mounting bracket which carries an electric motor and a suitable transmission terminating in a pinion in mesh with the rack.

Operation of the motor causes the assembly of the window, motor and transmission to move substantially vertically as a unit. Such movement is permitted by a suitable free length of conductor wiring leading to the motor.

The rack, which is normally slightly curved, is formed from a sheet metal strip which is bent into a channel cross section, one leg of the channel having a laterally outwardly extending flange remote from the bottom of the channel which is provided with rack teeth.

The bracket which connects the motor to the window includes generally horizontal flanges, each of which is provided with a guide formed of a suitable low-friction polymer, the guides having openings therein conforming to the cross sectional shape of the rack including projections extending within the rack channel and bearing against the side of the channel provided with the laterally extending, toothed flange.

The transmission, which interconnects the motor and the pinion engageable with the rack, comprises a worm connected to the armature of the motor and in mesh with a worm gear. The worm gear is rotatable on a fixed post and includes a plurality of pockets or recesses, each of which receives a compression spring. A pinion is rotatable on the post and has affixed thereto a spider provided with a plurality of arms. The worm gear is provided with a complete circular channel extending into the open ends of the spring receiving recesses. With this construction, when the motor is energized and the worm gear is driven in rotation, torque is transmitted to the pinion through the compression springs which are retained in the pockets or recesses provided in the worm gear.

BRIEF DESCRIPTION OF THE DRAWINGS

FIG. 11 is an enlarged sectional view on the line 11—11, FIG. 3.

FIG. 12 is a sectional view on the line 12—12, FIG. 11.

FIG. 13 is an exploded view of the transmission elements.

FIG. 14 is an elevational view of the worm gear as viewed at 14—14, FIG. 13.

FIG. 15 is an elevational view of the spider as viewed at 15—15, FIG. 13.

GENERAL DESCRIPTION

Figures 1, 3, 4, 5, 6, 16:
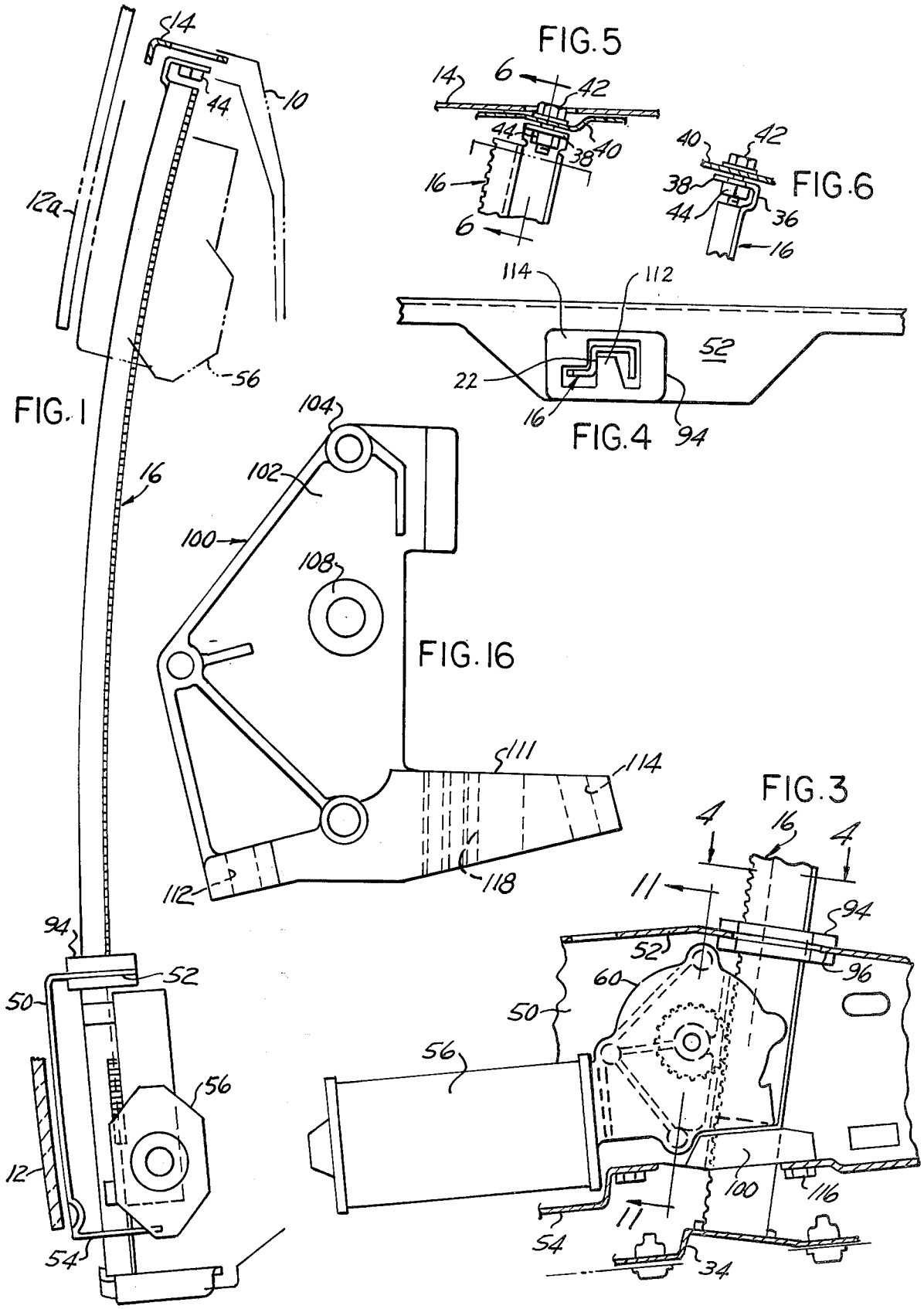
FIG. 1 is a fragmentary elevational view of the window regulating mechanism.
FIG. 3 is an elevational view of the motor and transmission with parts broken away.
FIG. 4 is a fragmentary section on the line 4—4, FIG. 3.
FIG. 5 is a fragmentary sectional view illustrating the bracket housing the upper end of the rack.
FIG. 6 is a fragmentary section view on the line 6—6, FIG. 5.
FIG. 16 is an elevational view of the lower guide element.

The window regulating mechanism as illustrated is mounted within a vertical door, a portion of which is indicated at 10 and which includes the window 12 which is movable from the open or lowered position at which its lower edge is viewed in full lines at the bottom of FIG. 1 to an upper closed position in which the lower edge, here designated 12*a*, is adjacent the bottom ledge 14 of the window opening.

Figure 9:
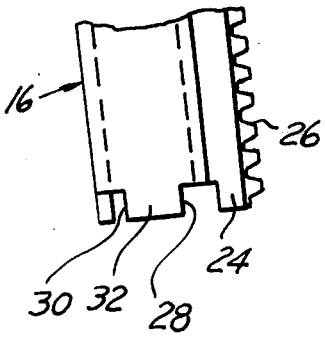
FIG. 9 is an enlarged end view as seen at 9—9, FIG. 7.
Figure 9:
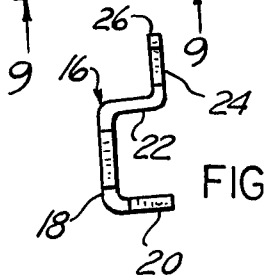

Mounted in the interior of the door structure is a rack 16, details of which are best seen in FIGS. 7 through 10. As best seen in FIG. 9, the rack is formed of a sheet metal strip which may conveniently have a thickness of about 0.090 inches. The rack is bent to provide a channel having a bottom wall 18 and side walls 20 and 22. The side wall 22 is in turn bent to provide a laterally outwardly projecting flange 24 provided with racked teeth 26. At its lower edge the rack 16 is provided with notches 28 and 30 leaving tangs such as indicated at 32 which are adapted to be received into openings provided in a rack supporting bracket 34 as illustrated in FIG. 3.

At its upper end the bottom wall 18 of the rack is bent to provide a longitudinally extending off-set flange 36 and a traversely extending apertured flange 38 which is secured as indicated in FIGS. 5 and 6 to the interior of the bottom sill 14 of the window opening by a bracket 40 having an opening through which extends a bolt 42 which engages a nut 44 affixed to the underside of the flange 38.

Since the geometry of the vehicle door is such as to require the window 12 to move in a slightly curved path, the rack 16 as best illustrated in FIG. 1 is given a corresponding curvature. This is conveniently accomplished as a flat strip is bent having the flanged channel into the configuration previously described.

Figures 2, 3A:
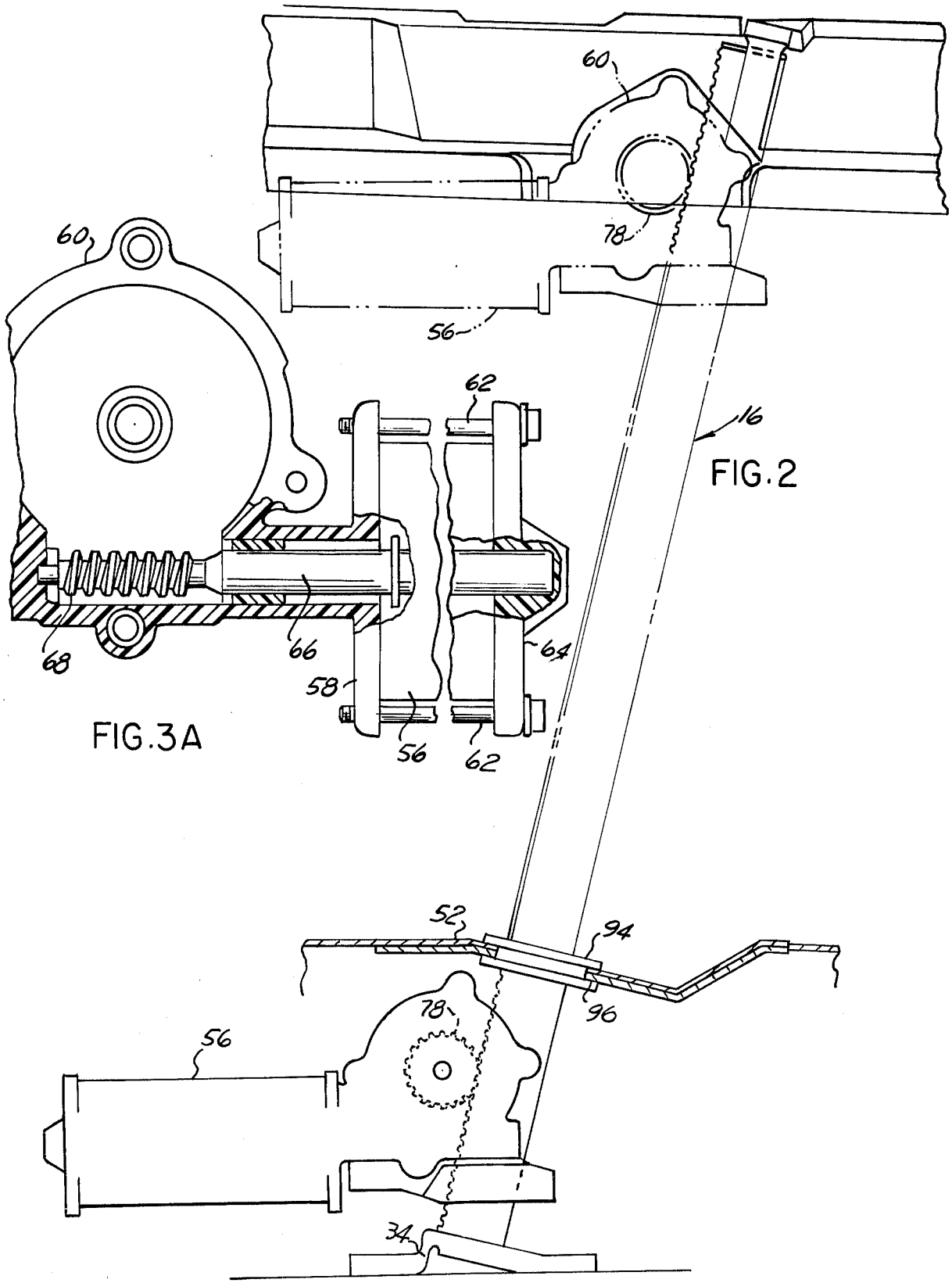
FIG. 2 is a view similar to FIG. 1 as viewed from the left in FIG. 1.
FIG. 3A is a fragmentary sectional view showing the mounting of the motor.
Figure 7:
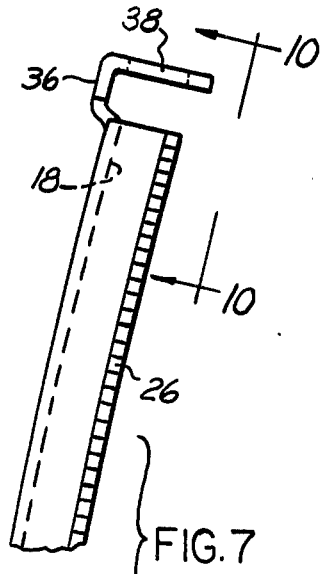
FIG. 7 is an elevational view of the rack with parts omitted.
Figure 10:
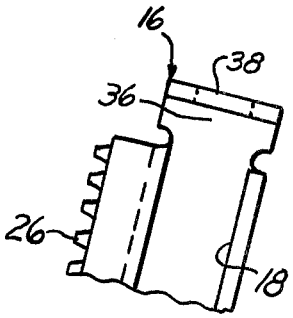
FIG. 10 is an enlarged end view as seen at 10—10, FIG. 7.
Figure 8:
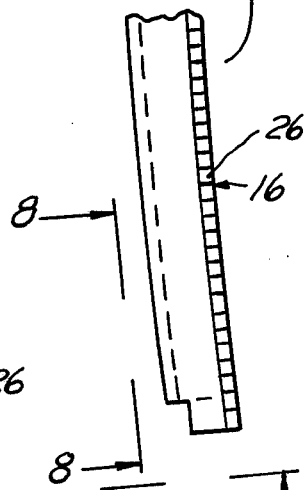
FIG. 8 is an enlarged view as seen at 8—8, FIG. 7.

The window 12 has affixed to its bottom edge a horizontally elongated bracket 50 having generally horizontal extended flanges 52 and 54. The electric motor 56 is bolted to the flange 58 of a transmission housing 60 as best seen in FIG. 3A. In this figure, it will be seen that the motor is secured by elongated clamping bolts 62 between the flange 58 and a plate 64. Suitably coupled to the armature of the motor is a shaft 66 provided at its end with a worm 68.

Referring now to FIGS. 11 through 15, the housing 60 has a generally cup-shaped portion provided with a bottom wall 70 which is thickened and apertured as indicated at 72 and receives a mounting post 74. Rotatable on the post within the cup-shaped portion of the housing is the worm gear 75 having teeth 76 which are in mesh with the worm 68.

Also rotatable on the post 74 is the pinion 77 having teeth 78 which mesh with the teeth of the rack 16. A driving spider 80 is fixed to the inner reduced end of the pinion 77 and has a configuration best illustrated in FIG. 15. As shown, the spider is provided with the non-circular opening 82 which fits a correspondingly shaped portion of the pinion and it is provided at its periphery with a plurality such as, for example, four tangs or dogs 84.

The worm gear 75 is provided at its inner side with a circular groove 86 which is interrupted by or extends through a plurality as for example, four spring-receiving recesses or pockets 88. The tangs 84 are circularly movable in the slot 86 and the edges of the tangs are movable into the end portions of the several spring-receiving pockets 88. Located within the pockets 88 are the coil compression springs 90 and as the edges of the tangs 84 move into the pockets, they engage springs 90 as will be apparent from an inspection of FIG. 12.

As the motor 56 is driven in rotation in one direction or another, it drives the shaft 66 carrying the worm 68 which meshes with the teeth 76 of the worm gear 75. As the worm gear 75 rotates relative to the spider, the pockets 88 move in such a way as to receive the edges of the tangs 84 which will compress the springs 90, thereby applying torque to the spider 80 and hence to the pinion 77. The action of the springs is to cushion the connection between the worm gear and the pinion while at the same time permitting the full torque of the motor to be applied when the springs are compressed to the extent necessary to cause movement of the window vertically with respect to the rack.

In order to obtain proper control and guidance of the window 12 as it moves into closed relationship, it is, of course, essential to provide accurate guiding action between the bracket secured to the lower edge portion of the window and the rack. This is accomplished by providing an upper guide 94 having slot 96 receiving edge portions of the upper flange 52 as best seen in FIGS. 3 and 4. The upper guide 94 is formed of a suitable hard plastic such as, for example, an acetal polymer sold under the trade name "Celcon" M-90-4 or an acetal homopolymer sold under the trade name "Delrin" 500. These resins or polymers provide the necessary strength for supporting and guiding a window construction including the motor on a rack and at the same time provide a substantially frictionless guiding action.

A corresponding lower guide is provided of somewhat complex configuration since it is designed to perform a plurality of functions. The lower guide is shown in its entirety at 100 in FIG. 16.

The guide 100 includes a plate portion 102, which is best seen in FIG. 11, cooperates with the housing 60 to form a partial enclosure for the transmission. For this purpose, the plate portion 102 is provided with elongated projections 104 which receive assembly bolts 106. In addition, the plate portion 102 is provided with an embossment 108 which is recessed at its inner side as indicated at 110 to receive the outer end of the post 74 as best illustrated in FIG. 11.

At its lower edge the guide 100 is provided with a thickened guide portion 111 having bolt receiving openings 112 and 114 for receiving assembly bolts 116 by means of which the guide is attached to the lower flange 54 of the window bracket 50. In addition, the thickened portion 111 is provided with an opening 118 having a configuration conforming to the cross sectional shape of the generally channel-shaped rack.

From an inspection of FIG. 4, it is apparent that guide 94 (as well as guide portion 111) have guide openings shaped to cooperate with the novel cross sectional shape of the rack. These guide openings include projecting elements 112 which extend into the channel of the rack and bear against the inner surface of the side wall 22 from which the toothed flange 24 extends. In addition the guide openings include inwardly extending corner projections 114 having bearing surfaces positioned to engage the outer surface of the channel wall 22, while of course providing for sliding movement of the guides on the rack.

From the foregoing, it is apparent that the guide 100 is rigidly bolted to the window bracket 50 and similarly is rigidly bolted to the transmission housing 60. The transmission housing 60, as best seen in FIG. 3A, is rigidly secured to the motor 56 by the assembly bolts 62, flange 58 and plate 64. Accordingly, the motor and transmission is rigidly attached to the window and is movable therewith. At the same time, the pinion 77 is in position to mesh with the rack 16.

What is claimed is:

1. In a window regulator for a vehicle window comprising a generally upright rack in an enclosure in which the window is received in open position, a bracket fixed to the lower edge of the window, a motor and transmission fixed to said bracket and movable therewith, said transmission including a pinion in mesh with said rack, the improvement in which the transmission includes a worm, a worm gear in mesh with the worm, said worm gear having a circular groove at one side intersecting a plurality of spring-receiving pockets, a compression spring in each of said pockets, a spider having a like plurality of tangs extending into said groove and engageable with the springs in said pockets, and a pinion fixed to said spider to be driven from said worm gear through said springs, a housing for said transmission including means for fixing said motor thereto, a cover for said housing formed of a low friction polymer and including an integral guide portion at its lower side, said bracket having upper and lower generally horizontal bracket flanges, said housing cover being fixed to said lower bracket flange, a low friction polymer guide fixed to said upper bracket flange, said rack being formed of an elongated metal strip bent longitudinally into channel form with an integral rack flange extending laterally from the outer edge of one of the sides of said channel, said rack flange having rack teeth formed at its free edge, said guide and guide portion having like guide openings including inwardly projecting elements received in the channel of said rack and bearing against the inner surface of the channel side wall from which said toothed rack flange extends.

2. A construction as defined in claim 1 said openings having bearing surfaces positioned to engage the outer surface of said last mentioned side wall.

3. A window regulator for a vehicle window movable into and out of an enclosure upon movement between closed and open positions, a bracket fixed to the lower edge of the window having vertically spaced generally horizontal bracket flanges, a motor and transmission including a drive pinion carried by said bracket, a generally vertical rack with which said pinion is in mesh, said rack comprising an elongated channel having opposite side walls and a rack flange extending laterally from the outer edge of one of said walls, low friction polymer guides carried by said bracket flanges, said guides having openings in which said rack is relatively slidable, said openings including inwardly projecting elements received in said channel and bearing against the channel side wall from which said toothed rack flange extends.

4. A window regulator as defined in claim 3, in which said openings also have bearing surfaces engageable with the outer surface of said one channel side wall.

5. A window regulator as defined in claim 3, in which said rack is in the form of an elongated metal strip bent longitudinally into channel form with said rack flange bent to extend laterally from the outer edge of said one channel wall.

6. A window regulator as defined in claim 3, in which the guide carried by said lower bracket flange comprises an integral guide portion and plate portion formed of low friction polymer, said plate portion being fixedly secured to said motor and transmission, whereby said guides constitute the means for supporting the motor, transmission and pinion slidably on said rack.

* * * * *